US005390966A

United States Patent [19]

Cox et al.

[11] Patent Number: 5,390,966

[45] Date of Patent: Feb. 21, 1995

[54] SINGLE CONNECTOR FOR SHUNT CONDUITS ON WELL TOOL

[75] Inventors: Larry L. Cox, Carrollton; Tommy J. Yates, Coppell, both of Tex.

[73] Assignee: Mobil Oil Corporation, Fairfax, Va.

[21] Appl. No.: 139,676

[22] Filed: Oct. 22, 1993

[51] Int. Cl.[6] ..... F16L 39/00

[52] U.S. Cl. ..... 285/137.1; 166/241.6; 285/417; 285/25; 285/28

[58] Field of Search ..... 285/137.1, 137.2, 24, 285/25, 28, 417; 166/241.1, 241.6, 341, 342, 348

[56] References Cited

U.S. PATENT DOCUMENTS

| | | | |
|---|---|---|---|
| 3,095,042 | 6/1963 | Clark, Jr. et al. | 285/137.2 |
| 3,340,932 | 9/1967 | Bloudoff | 285/137.1 |
| 3,516,492 | 6/1970 | Petersen | 285/137.1 |
| 3,806,168 | 4/1974 | McGee et al. | 285/137.2 |
| 3,933,203 | 1/1976 | Evans | 166/241.6 |
| 4,374,595 | 2/1983 | Watkins | 285/137.2 |
| 4,478,278 | 10/1984 | Klein | 166/241.1 |
| 4,483,395 | 11/1984 | Kramer et al. | 166/241.6 |
| 4,865,354 | 9/1989 | Allen | 285/137.1 |
| 4,945,991 | 8/1990 | Jones | 166/278 |
| 5,078,432 | 1/1992 | Seiter | 285/137.1 |
| 5,082,052 | 1/1992 | Jones et al. | 166/51 |
| 5,113,935 | 5/1992 | Jones et al. | 166/51 |
| 5,137,306 | 8/1992 | Flood | 285/137.1 |
| 5,161,613 | 11/1992 | Jones | 166/242 |
| 5,161,618 | 11/1992 | Jones et al. | 166/308 |

FOREIGN PATENT DOCUMENTS

| | | | |
|---|---|---|---|
| 2833866 | 2/1980 | Germany | 285/137.2 |

*Primary Examiner*—Eric K. Nicholson
*Attorney, Agent, or Firm*—Alexander J. McKillop; George W. Hager, Jr.

[57] ABSTRACT

A well tool (e.g. well screen) having a single connector for fluidly connecting the shunt conduits carried by adjacent joints of a well tool to thereby eliminate the need for separate, individual connectors. The single connector is slidably mounted on the central conduit of one of the joints and has a plurality of passages therethrough, each of which is adapted to receive a respective shunt conduit on one of the adjacent joints. After the central conduits of two adjacent joints are coupled together, the single connector is moved whereby the upper ends of the respective shunts on one joint enter the lower ends of the respective passages to thereby fluidly connect the respective shunt conduits. The single connector is then secured in a connected position.

8 Claims, 2 Drawing Sheets

SINGLE CONNECTOR FOR SHUNT CONDUITS ON WELL TOOL

DESCRIPTION

1. Technical Field

The present invention relates to a connector for the shunt conduits of a well tool and in one of its aspects relates to a single connector for fluidly connecting a plurality of individual shunt conduits which, in turn, are carried by respective joints of a well tool.

2. Background

In producing hydrocarbons or the like from loosely or unconsolidated and/or fractured subterranean formations, it is not uncommon to produce large volumes of particulate material (e.g. sand) along with the formation fluids. These particulates routinely cause a variety of problems which result in added expense and substantial downtime. For example, particulates in the produced fluids may cause (1) severe erosion of the well tubing and other production equipment; (2) partial or complete clogging of the flow from the well; (3) caving of the formation and collapse of the well casing; and (4) extra costs for processing and disposal of the particulates at the surface. Accordingly, it is extremely important to control the production of particulates in most operations.

"Gravel packing" is one of the most common techniques for controlling the production of particulates (e.g. sand) from the well. In a typical gravel pack completion, a screen is lowered into the wellbore and positioned adjacent the interval of the well which is to be completed. Particulate material, collectively referred to as gravel, is then pumped as a slurry down a workstring and exits above the screen through a "cross-over" or the like into the well annulus around the screen.

The liquid in the slurry is lost into the formation and/or flows through the openings in the screen which results in the gravel being deposited or "screened out" in the annulus around the screen. The gravel is sized so that it forms a permeable mass between the screen and the producing formation which allows flow of the produced fluids therethrough and into the screen while substantially blocking the flow of any particulate material therethrough.

One of the major problems associated with gravel packing, especially where long or inclined intervals are to be completed, involves the proper distribution of the gravel over the entire interval to be completed. Poor distribution of gravel (i.e. incomplete packing of the interval resulting in voids in the gravel pack) is often caused by the premature loss of liquid from the gravel slurry into the more permeable portions of the completion interval which, in turn, causes the formation of gravel (e.g. sand) "bridges" in the annulus before all of the gravel has been placed. These bridges block further flow of the slurry through the annulus thereby preventing the placement of sufficient gravel (a) below the bridge for top-to-bottom packing operations or (b) above the bridge, for bottom-to-top packing operations.

Recently, well tools have been developed which include means for providing a good distribution of gravel throughout the desired interval even if sand bridges form in the annulus before all the gravel has been deposited. In these tools (e.g. well screens), a plurality of perforated shunts or conduits are provided which extend along the external surface of the screen and which are in fluid communication with the gravel slurry as it enters the wellbore annulus adjacent the screen. If a sand bridge forms before all of the gravel is placed, the slurry will continue to flow through the shunt conduits and out into the annulus through the spaced perforations to complete the filling of the annulus above and/or below the bridge. For further details of such well tools, see U.S. Pat. Nos. 5,082,052 and 5,113,933, both of which are incorporated herein by reference.

Well tools such as those described above have been used successfully in the field. However, the assembly of these tools require substantial time and effort. That is, the length of a typical tool of this type is normally substantial (e.g. 1000 feet or more) and is made up of several 20-foot joints. Each joint is basically similar to the others in that they all are comprised of a length of screen or blank pipe (hereinafter referred to as "central conduit") which has a plurality of axially-extending, individual conduits or shunts secured thereto to form an integral unit or "joint".

In making-up or assembling these prior art well tools, the required number of joints are secured together to form a well tool having the desired length. This is done by first coupling the central conduits of adjacent joints together and then individually, fluidly connecting each of the shunt conduits on a joint to its respective shunt conduit on the adjacent joint. Since a typical joint normally has at least four parallel, axially-extending shunt conduits thereon, four individual connectors are required for making the necessary fluid connections between the shunt conduits of any two adjacent joints which, in turn, requires eight different physical connection manipulations ( i.e. one at each end of each individual connector ) to be made for each joint. Therefore, for a 1000 foot tool comprised of fifty, 20 foot joints, 200 connectors (i.e. 400 actual connections) are required to assemble the tool. As can be seen, this tedious assembly adds substantially to the time and overall costs involved in operations using these prior art well tools.

SUMMARY OF THE INVENTION

The present invention provides a well tool having a single connector for fluidly connecting all of the shunt conduits carried by a joint of a well tool (e.g. well screen with or without blanks) to their respective shunt conduits on an adjacent joint of the well tool in a single assembly operation thereby eliminating the need for a multitude of separate, individual connectors as is the case in prior art well tools of this type and thereby substantially reducing the number of actual physical manipulations connections previously required in making-up the tool.

The single connector of the present invention is comprised of a body which is preferably molded or otherwise formed of a resilent material, e.g. neoprene rubber or the like. The body has a central bore by which the body is slidably mounted on the central conduit of one of the joints. The body also has a plurality of axially-extending passages, each of which is adapted to receive a respective shunt conduit on the joint. The single connector is assembled onto the joint in a retracted or "disconnected" position.

To assemble the well tool, a central conduit of one joint is threaded or otherwise coupled to a central conduit of adjacent joint. The respective joints are torqued so that shunt conduits on the joints are aligned. The single connector is then moved downward whereupon the upper ends of the respective shunts on the adjacent joint enter the lower ends of their respective passages in the body to thereby effect a fluid connection between the respective shunt conduits. The single connector is then secured in its "connected" position by any appropriate means, e.g. a lock ring and set screw.

The body of the connector, being of resilent material, will allow the passages therein to deform and adapt as the respective shunt conduits are forced therein so that a good seal will be formed between the passages and the respective shunts. The body of the single connector may be split along its axis to provide two symmetrical portions which, in turn, are hinged or otherwise secured together so that the connector can be easily assembled onto central conduit of a joint.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
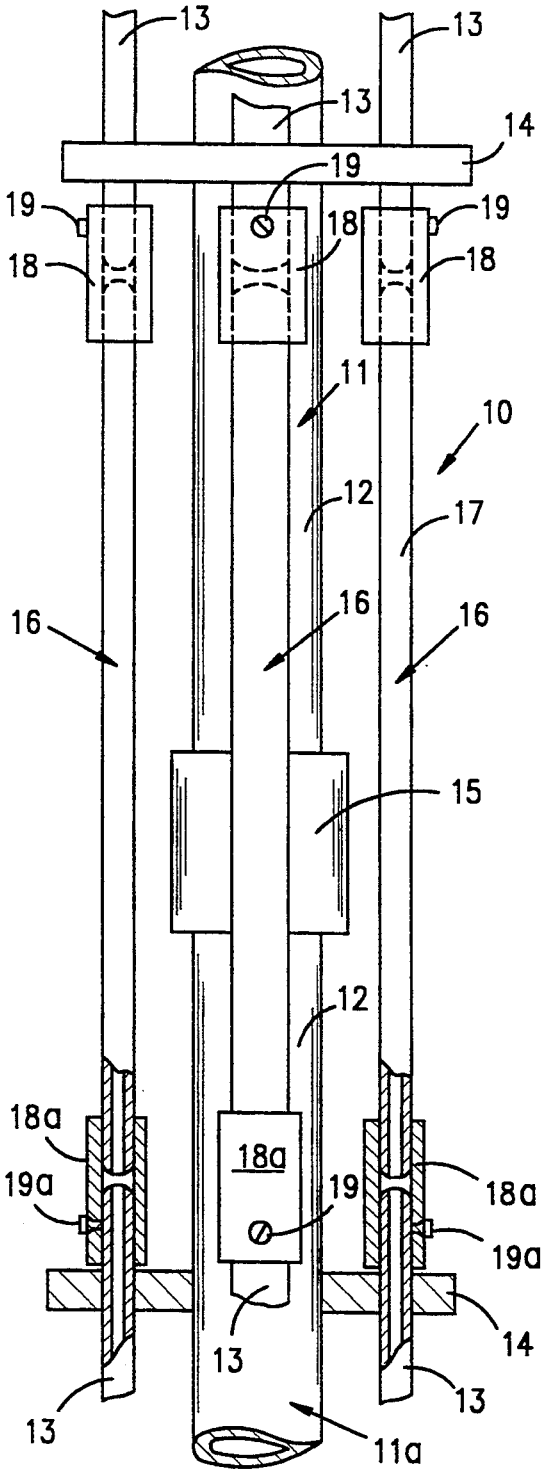
FIG. 1 PRIOR ART
FIG. 1 is a broken-away, elevational view, partly in section, of two adjacent joints of a prior art well tool having shunt conduits which are fluidly connected together by individual connectors.

Referring more particularly to the drawings, FIG. 1 illustrates a prior art well tool wherein individual connectors are used to fluidly connect respective shunt tubes or conduits on adjacent joints which make up the tool. More particularly, tool 10 is comprised of a plurality of lengths or "joints" 11 (only part of two adjacent joints shown) which are all substantially similar in basic construction. Each joint 11 is comprised of a central conduit 12 (e.g. a length of screen, blank pipe, or the like). The term "screen" is used generically herein and is meant to include and cover any and all types of permeable structures commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof).

Mounted on each joint 11 are a plurality of shunt tubes or conduits 13 (e.g. four, radially spaced at 90° intervals) which are parallel to each other and which extend axially along central conduit 12. Shunt conduits 13 are secured in place on central conduit 12 by support rings 14 or the like. To assemble tool 10, the respective central conduits 12 of two adjacent joints 11 , 11*a* are coupled together with a standard, threaded box-and-pin coupling 15 or the like. After the two joints have been joined and properly torqued, each of the shunt conduits 13 on joint 11 will axially align with a respective shunt conduit 13 on joint 11*a*. Next, each set of aligned shunt conduits are fluidly connected together by a separate, individual connector 16.

Each connector 16 is comprised of a length of connector conduit 17 (may be same as used for shunt conduits 13) having couplers 18, 18*a* positioned over the respective ends thereof. At least one of the couplers (e.g. 18*a*) is slidably positioned on connector conduit 17 so that connector can be assembled onto aligned shunt conduits 13 after the joints 11, 11*a* have been coupled together. That is, coupler 18 can be attached to conduit 17 and can be positioned onto the lower end of the shunt conduit 13 on joint 11 while coupler 18*a* is slidably retracted on the lower end of conduit 17. Once coupler 18 is in place on the upper shunt conduit 13, coupler 18*a* is then slid downward onto the upper end of lower shunt conduit 13 on joint 11*a*. Both couplers 18 and 18*a* are then secured in place by set screws 19, 19*a*, respectively. Of course, seals (e.g. O-rings, not shown) can be provided at the appropriate places on the conduit and/or couplers 18, 18*a*, if required.

The prior art well tool 10, illustrated in FIG. 1, normally will be made up of a large number of joints. For example, it is not unusual to need a well screen (i.e. comprised of screen and/or blank joints) having a length of 1000 feet or more. Joints for these types of screens are usually 20 feet long, thereby requiring 50 joints or more. As can be seen, such a prior art tool requires 200 separate, individual connectors and 400 physical, connections manipulations to assembly the well tool. This is both time-consuming and costly.

Figure 4:
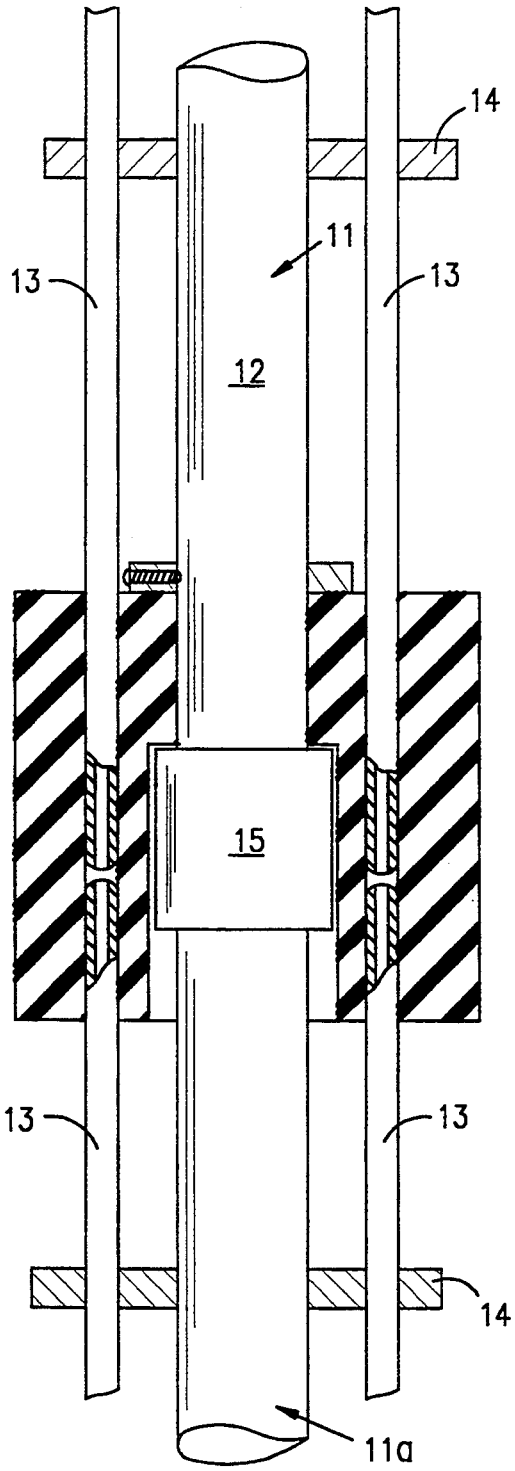
FIG. 4 is a broken-away, elevational view, partly in section, of the tool of FIG. 2 wherein the single connector is in a second or connected position.
Figure 2:
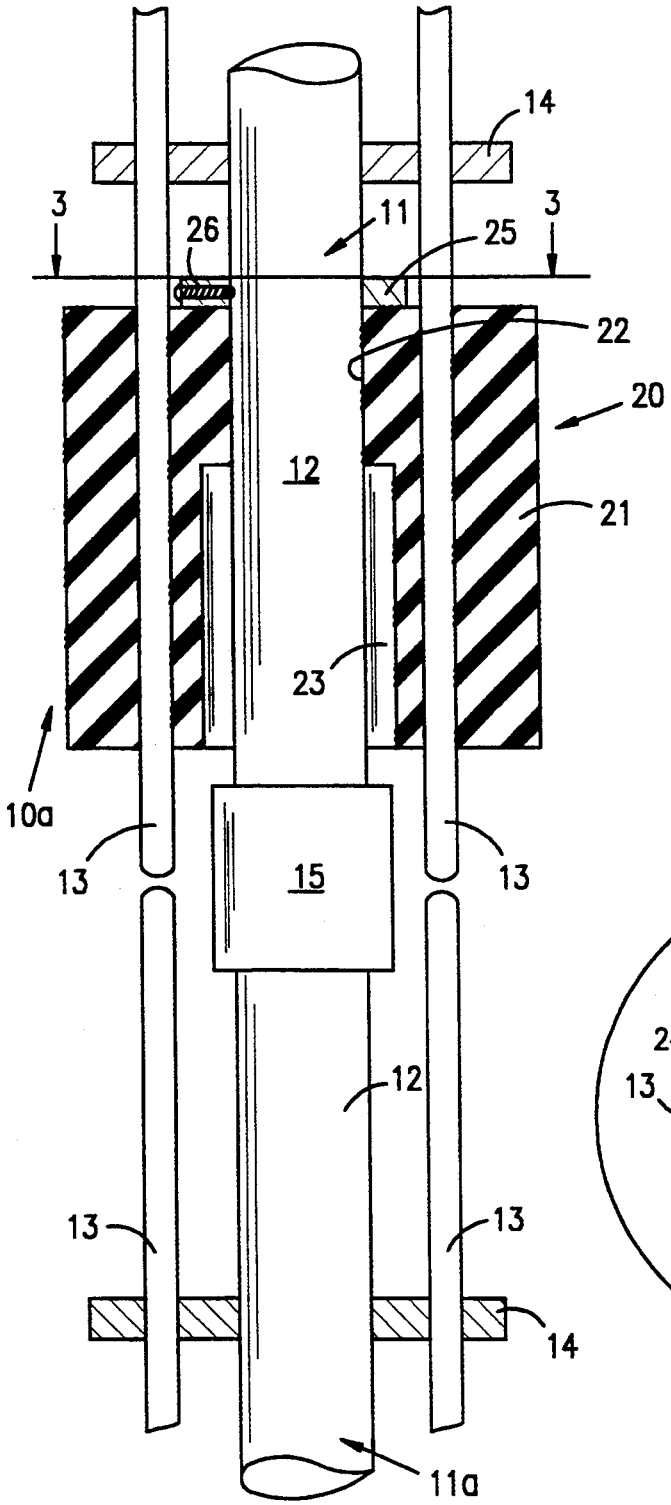
FIG. 2 is a broken-away, elevational view, partly in section, of two adjacent joints of the present well tool having a single connector for fluidly connecting a plurality of shunt conduits wherein the connector is in an original or disconnected position.
Figure 3:
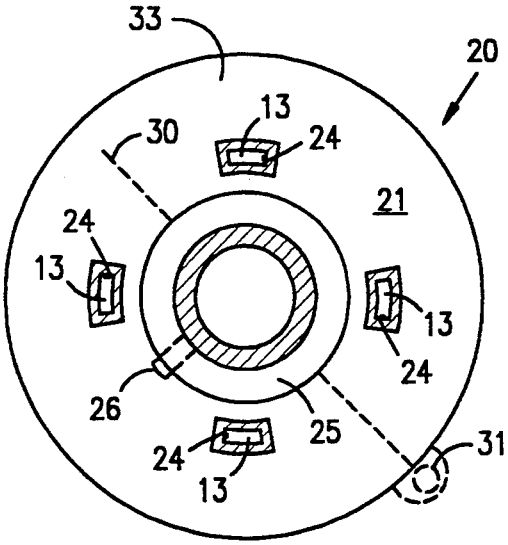
FIG. 3 is a sectional view taken along line 3—3 of FIG. 2.

Referring now FIGS. 2–4, in accordance with the present invention, a single connector 20 is provided for fluidly connecting all of the respective, aligned shunt conduits carried by two adjacent joints of a well tool. The single connector replaces the plurality of separate, individual connectors 16 shown in FIG. 1. It should be understood that while the joints 11, 11*a* of the tool 10*a* shown in FIG. 2 may be identical to those shown in FIG. 1, preferably they are slightly different in that shunt conduits 13 on respective joints 11, 11*a* have been extended so that their adjacent ends are in closer proximity to each other as shown in FIG. 2.

Single connector 20 is comprised of a body 21 which is preferably molded or otherwise formed of a resilent material, e.g. neoprene rubber. Body 21 has a central bore 22 therethrough which is adapted to receive central conduit 12 of joint 11. Bore 22 has an enlarged diameter portion or recess 23 which is adapted to receive coupling 15 when single connector 20 is moved from a retracted or "disconnected" position (FIG. 2) to a "connected" position (FIG. 4).

Body 21 also has a plurality of passages 24 which axially-extend therethrough and which are parallel to central bore 22. Each passage 24 is adapted to receive one of shunt conduits 13 on joint 11. Single connector 20 is assembled onto joint 11 by aligning bore 22 with central conduit 12 and passages 24 with the respective shunt conduits 13. Connector 20 is then moved upward (as viewed in FIG. 2) onto central conduit 12 and shunts 13 to its retracted or disconnected position on joint 11.

Next, central conduit 12 of joint 11 is threaded into coupling 15 on central conduit 12 of joint 11*a* to couple the two together. The respective joints are torqued so that each shunt conduit 13 on joint 11 is aligned with a respective shunt conduit 13 on joint 11*a*. Single connector 20 is then moved downward whereupon the upper ends of shunts 13 on joint 11*a* enter and are forced into the lower ends of respective passages 24 in body 21 thereby effecting a fluid connection between the respective, aligned shunt conduits 13. Connector 20 is then secured in its connected position (FIG. 4) by any appropriate means, e.g. a lock ring 25 which slides downward with connector 20 and is locked in place by set screw 26 or the like.

Body 21, being of resilent material, will allow passages 24 to deform and adapt as respective shunt conduits 13 are forced therein so that a good seal will be formed between the passages 24 and the respective shunts. It should be recognized that it is not critical that an absolute leak-proof connection be formed between the connector 20 and the respective shunt conduits 13 since slight leakage may be tolerated in most operations involving well tool 10*a*. However, sealing means (e.g. O-rings or the like, not shown) can be positioned on each of the shunt conduits to cooperate with the interior of the passages 24 to provide additional sealing for each connection, if desired.

Several modifications of connector 20 are possible without departing from the spirit of the present invention. For example, body 21 may be formed of a non-resilent material, e.g. steel, aluminum, etc., having passages 24 which cooperate with seal means (e.g. O-rings or the like) on each of the respective shunt conduits 13. Further, where the adjacent ends of the respective, aligned shunt conduits 13 do not extend into close proximity with each other but instead are shorter as shown in FIG. 1, body 21 of connector 20 may be split along its axis to provide two symmetrical portions which, in turn, are hinged or otherwise secured together so that the connector can be "opened" for easily assembly onto central conduit 12 of joint 11. The symmetrical portions may be "hinged" merely by not splitting the body all the way through but instead, leaving an axial rib 33 (FIG. 3) down the back side. This rib can then be weaken by notching or the like (not shown) to provide an integral hinge between the two portions of the connector 20. Once connector 20 is in position on central conduit 12, the two portions thereof may be secured together by a pin or the like (dotted lines 31 in FIG. 3).

What is claimed is:

1. A well tool comprising:

at least two joints, each of said joints comprising:

a central conduit; and a plurality of parallel, axially-extending shunt conduits carried by central conduit;

means for connecting said central conduits of said at least two joints together whereby said plurality of shunt conduits on one of said joints will be axially aligned respectively with said plurality of shunt conduits on the other of said joints; and a single connector for fluidly connecting respectively each of said plurality of shunt conduits on said one joint to each of said plurality of shunt conduits on said other joint; said single connector comprising:

a body positioned on said central conduit of said one joint, said body having a central bore adapted to receive said central conduit of said one joint when said body is positioned on said one joint; and a plurality of passages axially extending through said body, each of said passages adapted to receive a respective one of said plurality of shunt conduits on said one joint into a first end of said passage and a respective one of said plurality of shunt conduits on said other joint into the other end of said passage to thereby fluidly connect said respective aligned shunt conduits when said single connector is in a connected position.

2. The well tool of claim 1 wherein said body is comprised of resilent material.

3. The well tool of claim 2 wherein said single connector is slidably mounted on said one joint in a disconnected position before said central conduits of said at least two joints are coupled together.

4. The well tool of claim 3 wherein said single connector is moved to said connected position after said central conduits of said at least two joints are coupled together.

5. The well tool of claim 4 including:

means for securing said single connector in said connected position.

6. The well tool of claim 5 wherein said means for securing said single connector comprises:

a ring slidably mounted on said central conduit of said one joint above said single connector and movable into contact with the top of said single connector when said connector is in said connected position; and means to lock said ring against further slidable movement to thereby secure said single connector in said connected position.

7. The well tool of claim 6 wherein said means to lock said ring comprises:

a set screw.

8. The well tool of claim 7 wherein said body is formed of two symmetrical portions which are hinged together whereby said body can be assembled onto said central conduit of said one joint.

* * * * *